US007268287B2

(12) United States Patent
Kawashima

(10) Patent No.: US 7,268,287 B2
(45) Date of Patent: Sep. 11, 2007

(54) MUSIC DATA PROVIDING APPARATUS, MUSIC DATA RECEPTION APPARATUS AND PROGRAM

(75) Inventor: Susumu Kawashima, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 244 days.

(21) Appl. No.: 10/616,202

(22) Filed: Jul. 9, 2003

(65) Prior Publication Data

US 2004/0011190 A1 Jan. 22, 2004

(30) Foreign Application Priority Data

Jul. 11, 2002 (JP) ..... 2002-202505

(51) Int. Cl.
*G10H 1/00* (2006.01)

(52) U.S. Cl. ..... 84/600; 705/26

(58) Field of Classification Search ..... 84/600–609, 84/645; 715/168–178; 709/246–247; 705/26
See application file for complete search history.

(56) References Cited

U.S. PATENT DOCUMENTS 5,883,957 A * 3/1999 Moline et al. ..... 705/57
6,143,973 A * 11/2000 Kikuchi ..... 84/645
6,308,222 B1 * 10/2001 Krueger et al. ..... 709/247
6,429,366 B1 * 8/2002 Terada ..... 84/645
6,528,715 B1 * 3/2003 Gargi ..... 84/615
2002/0000156 A1 1/2002 Nishimoto et al.
2003/0156600 A1 * 8/2003 Tsunoda et al. ..... 370/474

FOREIGN PATENT DOCUMENTS

| | | |
|---|---|---|
| EP | 1197883 | 4/2002 |
| JP | 2001-243707 | 9/2001 |
| JP | 2001-290476 | 10/2001 |
| JP | 2002-073053 | 3/2002 |
| JP | 2002-091436 | 3/2002 |
| JP | 2002-149166 | 5/2002 |

OTHER PUBLICATIONS

Canadian Office Action dated Apr. 18, 2006 issued on corresponding application No. 2,434,777.
Japanese Office Action dated May 16, 2006.
Japanese Office Action Aug. 8, 2006.

* cited by examiner

*Primary Examiner*—Lincoln Donovan
*Assistant Examiner*—David S. Warren
(74) *Attorney, Agent, or Firm*—Harness, Dickey & Pierce, PLC

(57) ABSTRACT

A music data providing apparatus comprises: a storage device that stores music data in a musical performance data event format; a receiver that receives a request for providing music data and a setting parameter from a user via a network; a converter that, in accordance with the received request and setting parameter, reads the music data in a musical performance data event format from the storage device and converts the read music data into music data in an audio data format; and a transmitter that transmits the converted music data in an audio data format to the user. Music data in various data format can be provided.

12 Claims, 5 Drawing Sheets

MUSIC DATA PROVIDING APPARATUS, MUSIC DATA RECEPTION APPARATUS AND PROGRAM

CROSS REFERENCE TO RELATED APPLICATION

This application is based on Japanese Patent Application 2002-202505, filed on Jul. 11, 2002, the entire contents of which are incorporated herein by reference.

BACKGROUND OF THE INVENTION

A) Field of the Invention

This invention relates to a music data providing apparatus and a music data reception apparatus, and more in detail, a music data providing apparatus that provides musical data via a network and music data reception apparatus that receives provided music data.

B) Description of the Related Art

Conventionally, there is a music data providing system that connects a music data providing apparatus (server) storing a large number of music data to a music data reception apparatus (client). In this music data providing system, a server provides musical data to a client in accordance with a request for providing music data from the client.

As a format of the music data to be provided, a performance data event format such as MIDI format and a compressed or uncompressed digital audio data format are generally used. Music data with a musical performance data event format (hereinafter called just musical performance data) is generally smaller in data size than that of musical data with an audio data format (hereinafter called audio data) it is advantageous in a case of using a slow communication network.

However, in order to reproduce musical performance data on the client corresponding to the musical performance data event format, a musical tone generating device (MIDI-to-Audio converting unit) for generating audio data based on the musical performance data such as, for example, a software synthesizer, MIDI musical tone generator or the like is necessary. On the other hand, in order to reproduce audio data, the MIDI-to-Audio converting unit is not necessary and is more general.

As described in the above, since audio data is larger in data size than that of the musical performance data, it takes a time for data to be provided. Although it can be considered that the data is provided in the format of the musical performance data, MIDI-to-Audio converting unit is necessary for reproducing the musical performance data, and a client terminal that does not equip it cannot reproduce the musical performance data.

Also, performance and a reproducible musical performance data event format of the MIDI-to-Audio converting unit are different from each other, and therefore, the musical performance data may not be reproduced as intended. For example, in a case that a client terminal has only a low-performance MIDI-to-Audio converting unit, audio data generated by conversion may be unnatural.

As described in the above, in a music data providing service by the musical performance data event format, the reproduction of the musical performance data may lose the uniformity of sound quality and the like depending on the performance ability of the client terminal. In order to solve the problem, music data provide with audio data format is preferable.

However, music data with various kinds of formats (for example, various kinds of sound qualities, musical performance time, pitches and the like) for one music may be requested. In order to satisfy the request, it is necessary to prepare music data with various kinds of formats.

SUMMARY OF THE INVENTION

It is an object of the present invention to provide a music data providing apparatus that can provide music data in various kinds of formats.

It is another object of the present invention to provide a music data reception apparatus that can receive and reproduce music data in various kinds of formats by connecting to the server.

It is further object of the present invention to provide a music data providing apparatus that can provide music data in a format requested by a user regardless of performance of an apparatus on the user's side.

Further, it is still another object of the present invention to provide a music data reception apparatus that can receive and reproduce music data in a requested format regardless of performance of an apparatus on the user's side.

According to one aspect of the present invention, there is provided a music data providing apparatus, comprising: a storage device that stores music data in a musical performance data event format; a receiver that receives a request for providing music data and a setting parameter from a user via a network; a converter that, in accordance with the received request and setting parameter, reads the music data in a musical performance data event format from the storage device and converts the read music data into music data in an audio data format; and a transmitter that transmits the converted music data in an audio data format to the user.

According to another aspect of the present invention, there is provided a music data receiving apparatus, comprising: a transmitter that requests conversion of music data in a musical performance data event format into music data in an audio data format and transmission of the converted music data by transmitting a request for providing music data and a setting parameter to a server storing music data in a musical performance data event format via a network; and a receiver that receives music data in an audio data format converted in accordance with the transmitted request and setting parameter via the network.

According to further aspect of the present invention, there is provided a music data receiving apparatus, comprising: a transmitter that requests transmission of music data in a musical performance data by transmitting a request for providing music data to a server storing music data in a musical performance data event format via a network; a receiver that receives music data in a musical performance data event format provided in accordance with the transmitted request via the network; a temporal storage device that temporally stores the received music data in a musical performance data event format; an input device that inputs a setting parameter for the received music data in a musical performance data event format; a converter that converts the music data stored in the temporal storage device into music data in an audio data format in accordance with the input setting parameter; and a deleting device that deletes the music data in a musical performance data event format stored in the temporal storage device automatically after the conversion of the converter.

According to the present invention, a music data providing apparatus that can provide music data in various kinds of formats can be provided.

Also, according to the present invention, a music data reception apparatus that can receive reproduce music data in various kinds of formats by connecting to the server can be provided.

Further, according to the present invention, a music data providing apparatus that can provide music data with a format requested by a user regardless of performance of an apparatus on the user's side can be provided.

Further, according to the present invention, a music data reception apparatus that can receive and reproduce music data in a requested format regardless of performance of an apparatus on the user's side can be provided.

DETAILED DESCRIPTION OF THE PREFERRED EMBODIMENTS

Figure 1:
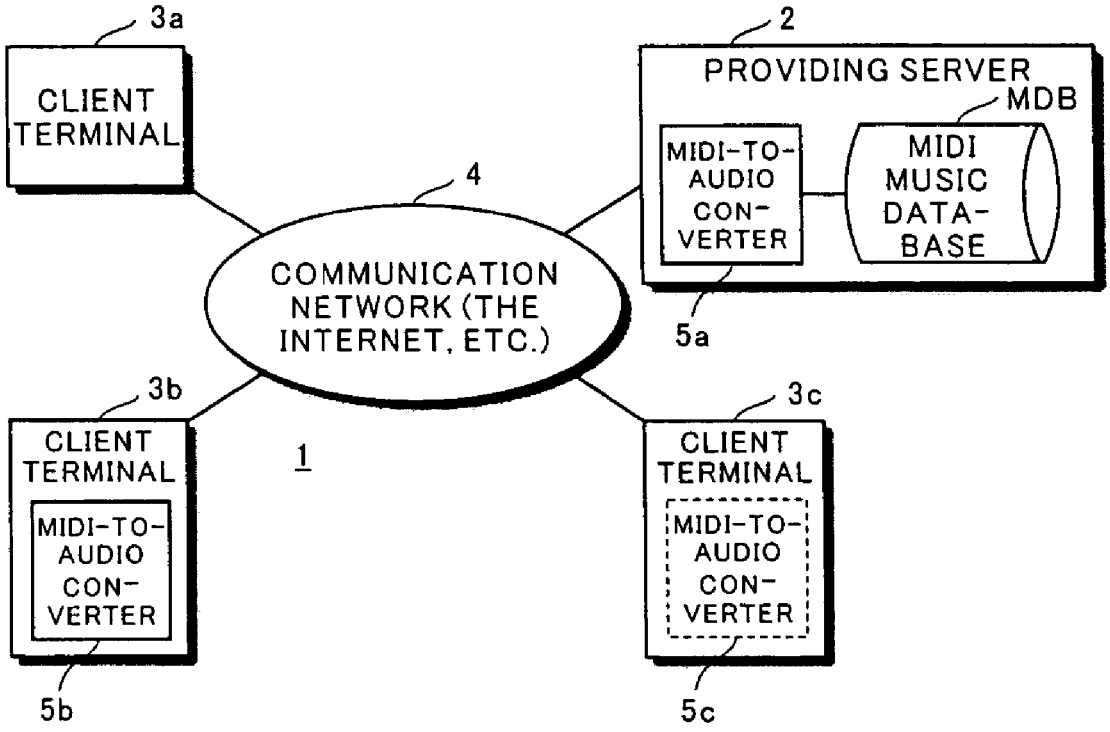
FIG. 1 is a schematic diagram of a music data providing system according to an embodiment of the present invention.

FIG. 1 is a schematic diagram of a music data providing system according to an embodiment of the present invention.

A music data providing apparatus 1 is consisted of at least one providing server 2 and a plurality of client terminals 3 (3*a* to 3*c*) connecting with each another via a public communication network 4 such as the Internet. The communication network 4 may be not only wired communication network, but also wireless communication network.

The providing server 2 is consisted of, for example, a personal computer, a server apparatus and the like, and has at least a MIDI-to-Audio converting unit that converts Music data in MIDI format to music data in an audio data format and a MIDI music database MDB that stores a plurality of music data (for example, MIDI format (a musical performance event data format) consisted of a series of performance event data such as key-on, key-off, program change, etc.). The providing server 2 can be connected to the client terminal 3 via the communication network 4.

The providing server 2 receives a request for providing (hereinafter called a providing request) and setting parameter from at least one of the client terminals 3 via the communication network 4 and converts, for example, Music data in MIDI format in the MIDI-to-Audio converting unit 5*a*, into music data in an audio data format corresponding to the received providing request and the setting parameter. Thereafter, the converted music data in audio data format is provided to the client terminal. Further, depending on the user's instruction, the music data in MIDI format can be provided to the client terminal without converting into music data in an audio data format, and the client terminal 3 can execute the converting process.

A client terminal 3 (either one of the client terminals 3*a* to 3*c*) is, for example, either one of a personal computer, a mobile information terminal, a cellular phone, and an electrical musical device. Further, in the embodiment of the present invention, the client terminals 3*a* to 3*c* that have differences in performances of the MIDI-to-Audio converting functions each other are connected to the communication network 4 as client terminals 3.

Each of the client terminals 3*a* to 3*c* transmits a music providing request and setting data to the providing server 2, receives and reproduces music data provided by the providing server 2 in accordance with the providing request and setting data.

Since the client terminal 3*a* does not have a MIDI-to-Audio converting unit, it is necessary to execute MIDI-to-Audio conversion on the providing server side. A request for MIDI-to-Audio conversion is included in the above setting data to be transmitted. The client terminal 3*a* downloads music data converted to audio data in the providing server 2 via the communication network 4 and stores it. Moreover, the stored music data can be reproduced at anytime.

The client terminal 3*b* has a high-performance MIDI-to-Audio converting unit 5*b* of which performance is similar to or approximately similar to the MIDI-to-Audio converting unit 5*a* in the providing server 2.

The client terminal 3*c* has a low-performance MIDI-to-Audio converting unit 5*c* of which performance is lower than the MIDI-to-Audio converting unit 5*a* in the providing server 2 and the MIDI-to-Audio converting unit 5*b* in the client terminal 5*b*.

Since the client terminals 3*b* and 3*c* have the MIDI-to-Audio converting units 5*b* or 5*c*, they can receive music data in the format of the musical performance data from the providing server 2 and reproduce it. Moreover, in a case of receiving musical data in the musical performance data event format, musical data is provided by a quasistreaming providing process described later.

Also, in the client terminals 3*b* and 3*c*, as same as the client terminal 3*a*, MIDI-to-Audio conversion at the providing server 2 side can be requested. Especially, in the client terminal 3*c* with the low-performance MIDI-to-Audio converting unit 5*c*, conversion on the providing server 2 side is preferable.

In a case of using the client terminal 3*b* or 3*c*, a user can choose either one of musical performance data event format or audio data format and downloading musical data in the selected format. In a case that a communication speed of the communication network 4 is slow (low communication rate), a rapid download can be achieved by choosing download the music data in the musical performance data event format. On the other hand, in a case of connecting via the communication network 4 with satisfactory communication speed, high-fidelity audio data converted in the proving server 2 may be downloaded.

Figure 2:
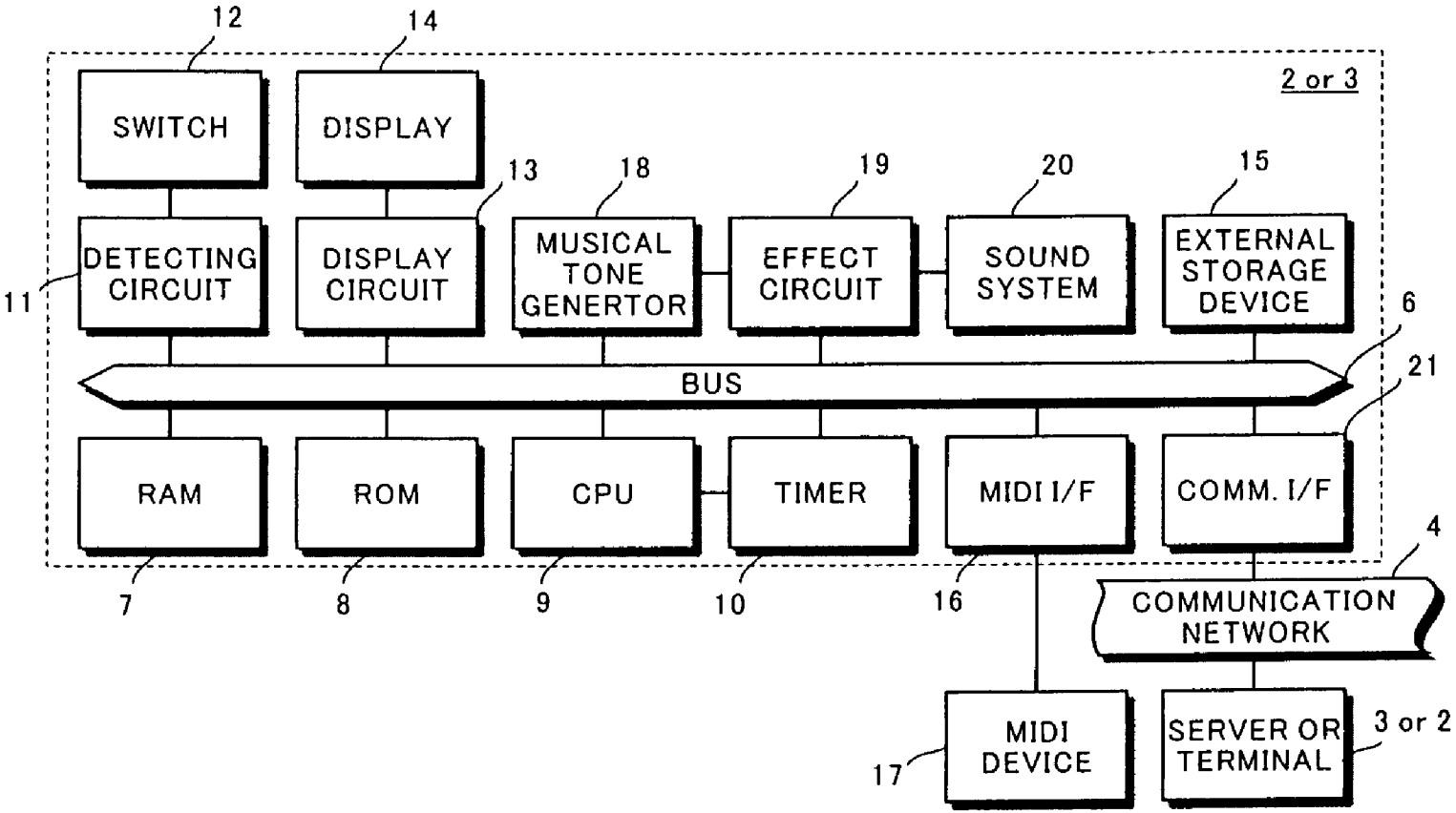
FIG. 2 is a block diagram showing hardware structure of a providing server 2 or a client terminal 3 according to the embodiment of the present invention.

FIG. 2 is a block diagram showing a hardware structure of a providing server 2 or a client terminal 3 according to the embodiment of the present invention.

The proving server 2 (the client terminal 3) is consisted of a bus 6, a RAM 7, a ROM 8, a CPU 9, a timer 10, a detecting circuit 11, an operating switch 12 including a panel switch and a musical performance switch, a display circuit 13, a display 14, an external storage device 15, a MIDI interface 16, a musical tone generator 18, an effect circuit 19, a sound system 20 and a communication interface (I/F) 21.

The RAM 7, the ROM 8, the CPU 9, the external storage device 15, the detecting circuit 11, the display circuit 13, the MIDI interface 16, the musical tone generator 18, the effect circuit 19, and the communication interface (I/F) 21 are connected to the bus 6.

The RAM 7 provides a working area to the CPU 9, stores a flag, a register or various kinds of parameters and the like and works as a buffer. Various kinds of parameters and a controlling program or programs for realizing the embodiment of the present invention can be stored in the ROM 8. In this case, it is not necessary that programs are stored in the external storage device 15.

The CPU 9 executes calculation or control in accordance with a controlling program and the like stored in the ROM 8 or the external storage device 15. The timer 10 is connected to the CPU and provides interrupt timing and the like to the CPU 9.

The user can perform various kinds of inputs and settings by using the operating switch 12 connected to the detecting circuit 11. The operating switch 12 may be anything that can output a signal corresponding to input operations by the user, for example, a switch, a pad, a fader, a slider, an alphanumeric keyboard, a mouse, a rotally encoder, a joy-stick, a jog-shuttle and the like.

Also, the operating switch 12 may be a software switch and the like displayed on the display 14 to be operated by using other switching device such as the mouse and the like.

The display circuit 13 is connected to the display 14, and can display various kinds of information on the display 14. The user executes various kinds of input and settings by referring the information displayed on the display 14. Also, the display 14 may be consisted by connecting an external display device.

Also, a touch panel can be used for the display 14. In this case, a user's instruction is input by pushing the switch and the like displayed on the display 14.

The external storage device 15 includes an interface for the external storage device and is connected to the bus 6 via the interface. The external storage device 15 is, for example, a flexible disk or a floppy (trade mark) disk drive (FDD), a hard disk drive (HDD), a magneto-optical (MO) drive, a CD-ROM (compact disk-read-only memory) drive, a digital versatile disk (DVD) drive, a semiconductor memory or the like.

In a case that the hard disk drive (HDD) is connected as the external storage device 15, the controlling program and programs for realizing the embodiment of the present invention can be also stored in the hard disk drive (HDD) in the external storage device 15. It can make the CPU 9 execute an operation as same as the case of storing the controlling program and the like in the ROM 8 by reading the controlling program and the like from the hard disk to the RAM 7. By doing that, adding a controlling program and the like and version up can easily be executed.

Also, in addition to the hard disk drive, in a case that the CD-ROM drive is connected, the controlling program and programs for realizing the embodiment of the present invention can be also stored in the CD-ROM. The controlling program and programs for realizing the embodiment of the present invention can be copied from the CD-ROM to the hard disk. Adding a controlling program and the like and version up can easily be executed.

In a case of the providing server 2, a plurality of music data with musical performance data event format is stored in the external storage device 15, and the MIDI music database MDB in FIG. 1 is constructed.

The MIDI interface (MIDI I/F) 16 can be connected to a MIDI device 17, other musical instrument, an audio device, a computer and the like, and at least can transmit and receive a MIDI signal. The MIDI interface 16 is not limited to be a dedicated MIDI interface, may be consisted by using a general interface such as an RS-232C, a USB (universal serial bus), an IEEE1394 and the like. In this case, data other than MIDI message may be transmitted and received at the same time.

The MIDI device 17 is an audio device, a musical instrument, etc. connected to the MIDI interface 16. A form of the MIDI device 17 is not only a keyboard instrument but may be a stringed instrument type, a wind instrument type, a percussion instrument type, etc. Also, the MIDI device 17 is not limited to one electronic musical instrument having built-in musical tone generator and automatic performance device, but also is consisted of a plurality of individual devices connected with each another by a communication network such as MIDI, etc. The user can perform input of musical performance information by operating the MIDI device 17 as a musical performance operating switch 12*b*.

Also, the MIDI device 17 can also be used as an operating switch 12 for inputting various kinds of data and settings other than musical performance information.

The musical tone generator 18 can convert music data with musical performance data event format to music data with audio data format. Also, the musical tone generator 18 can generate musical signal in accordance with music data recorded in the external storage device 15, the ROM 8, or the RAM 7, or a musical performance signal provided from the MIDI device 17, etc. connected to the MIDI interface 16, and the generated musical signal is provided to the sound system 20 via the effect circuit 19.

The effect circuit 19 adds various kinds of musical effects to the musical signal provided from the musical tone generator 18.

The musical tone generator 18 and the effect circuit 19 form the MIDI-to-Audio converting units 5*a* to 5*c* in FIG. 1. Also, the musical tone generator 18 and the effect circuit 19 are not limited to built-in types, and may be an external musical tone generating device to be connected to the MIDI interface 16 and the like.

Moreover, the musical tone generator 18 may be any one of a wave form memory type, a FM type, a physical model type, a high frequency wave synthesizing type, a formant synthesizing type, an analogue synthesizing type of a voltage controlled Oscillator (VCO)+a voltage controlled filter (VDF)+a voltage controlled amplifier (VCA), an analogue simulation type and the like.

Also, the musical tone generator 18 and the effect circuit 19 are not limited to be consisted of a dedicated hardware, and may be consisted of a digital signal processor (DSP) and a micro program. Also, they may be consisted of the CPU and software program or a sound card.

The sound system 20 includes a D/A converter and a loud speaker, and converts a provided musical signal in a digital format into an analogue format to sound music.

The communication interface 21 can be connected to a public communication network 4 such as a LAN, the Internet, a telephone line and the like, and the communication network 4 enables connections to other terminals 3 and/or the server 2.

Moreover, the communication interface 21 and the communication network 4 may be not only wired, but wireless. Also, both of them can be equipped with. Also, the communication interface 21 may be a built-in type in the providing server 2 (client terminal 3) and may be a removable type such as a PC card.

Figure 3:
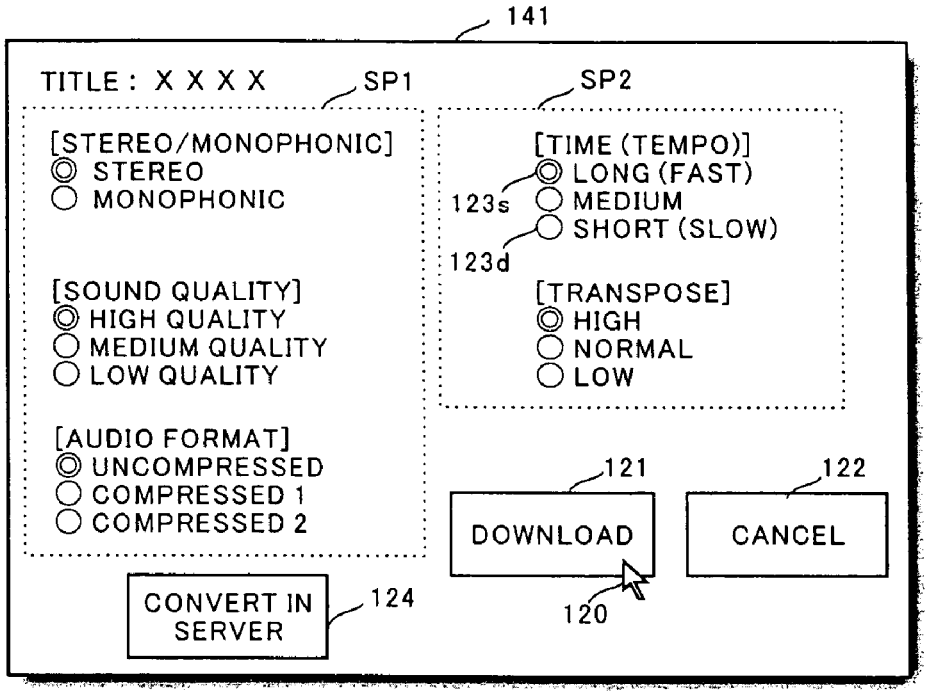
FIG. 3 is an example of a download setting screen 141.

FIG. 3 is an example of a download setting screen 141. The download setting screen is displayed on the display 14 (FIG. 2) in the client terminal 3 based on the download setting display data transmitted from the providing server 2 to the client terminal 3 in the music data providing process shown in FIG. 4.

On the download setting screen 141 are displayed at least a name of selected song requested to download, a first setting parameter group SP1 for converting music data corresponding to the selected song from musical performance data event format to audio data format, a second parameter group SP2 for setting the music data in the musical performance data event format, a download button 121 for requesting (a providing request) download to the providing server 2 and a cancel button 122 for canceling download. Also, a selecting switch 124 for selecting whether conversion from musical performance data event format into audio data format is executed in the providing server 2 or not. Switches (for example, toggle switches as shown in FIG. 3) 123 for selecting each setting parameter are provided near each of the setting parameters of the first and second parameter groups SP1 and SP2. The user operates a cursor 120 by using the operating switch 12 and the like in FIG. 2 and executes operations of setting of each parameter, the downloading button 121 and the cancel button 122. In the drawing, the selecting switch 123*s* indicates a state that a next setting parameter is selected, and the selecting switch 123*d* indicates a state of being not selected.

The first setting parameter SP1 includes setting parameters for converting music data from the musical performance data event format to the audio data format, for example, a selection of stereophonic or monophonic recording sound, a selection of sound qualities from the low quality to high quality, a selection of the audio data format and the like. Also, not limited to the above, any parameters that are necessary for converting the music data from musical performance data event format data to audio data format data.

The sound quality of audio data is determined by, for example, a sampling frequency and a bit rate. In the embodiment of the present invention, the sampling frequency and the bit rate corresponding to each of low quality, medium quality and high quality are determined in advance. Moreover, the user may be able to change the sampling frequency and the bit rate. Also, the user may be able to input numeric value of the sampling frequency directly.

A compression format of audio data can be selected from, for example, uncompressed wave data and other plurality of compressed formats. Any audio data formats that are generally used as an audio data compression format may be used. Also, setting parameters that the user can select may be changed corresponding to the selected compression format.

The second setting parameter group SP2 includes setting parameters for setting a reproducing condition of the music data in the musical performance data event format. A selected music data is reproduced based on the second setting parameters and converted into audio data format based on the first setting parameter group SP1.

Setting of musical performance time (tempo) is selected from "long (slow)", "standard" and "short (fast)", and a tempo corresponding to each setting is determined in advance. As same as the above-described qualities, the user may be able to input numeric value corresponding to a desired tempo directly, and the tempo may be changed continuously.

Setting of transpose is selected from making high, standard and making low, and a transpose value corresponding to each setting is determined in advance. As same as the above-described quality, the user may be able to input numeric value corresponding to a desired transpose value directly, and the transpose value may be changed continuously.

In the embodiment of the present invention, although only two types of the above-described parameters are explained as the second setting parameter group SP2, necessity of an effect process to the music data, a type of the effect process, detailed setting of the effect process, change of tone and volume, a selection of musical performance part, a selection of musical performance duration (only the main theme, only the intro part, only for one chorus, whole part of the song and the like) may be set by displaying a screen for setting those parameters in the download setting screen 141.

Moreover, in addition to the above switches, a selecting switch whether conversion of the music data from the musical performance data event format to the audio data format is executed in the client terminal 3 or not may be provided.

Figure 4:
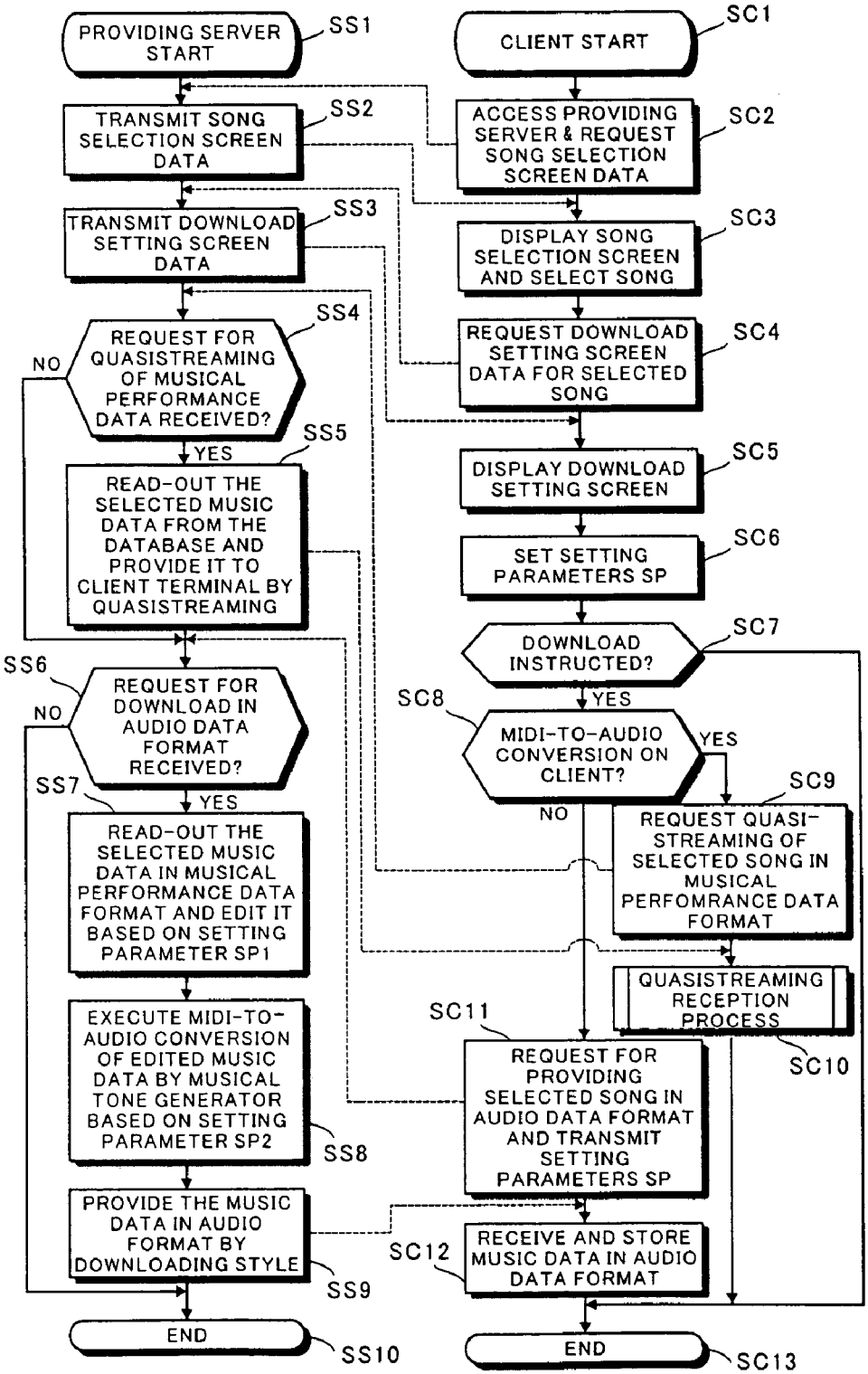
FIG. 4 is a flow chart representing a music data providing process executed in a music data providing system 1 according to the embodiment of the present invention.

FIG. 4 is a flow chart showing a music data providing process executed in a music data providing system 1 according to the embodiment of the present invention. In the drawing, broken lines indicate data flows. Steps SS1 to SS10 are processes executed in the providing server 2, and Steps SC1 to SC13 are processes executed in the client terminal 3. Moreover, both of the providing server 2 and the client terminal 3 have already been connected to the communication network 4 (FIG. 1).

At Step SS1, the process on the providing server 2 side is started, and song selection screen data is transmitted to the client terminal 3 at Step SS2.

At Step SS3 download setting screen data, for example, corresponding to the download setting screen 141 as shown in FIG. 3 is transmitted to the client terminal 3. The download setting screen data to be transmitted relates to the music data corresponding to the song selected at Step SC3 described later.

At Step SS4, it is judged whether a quasistreaming providing request in a musical performance data event format (for example, MIDI format) is received from the client terminal 3 or not. In a case that the quasistreaming providing request is received, the selected music data is read from the MIDI music database MDB (FIG. 1) to execute quasistreaming providing to the client terminal 3 at Step SS5. In a case that the quasistreaming providing request is not received, the process proceeds to Step SS6 as indicated by an arrow marked "NO".

The quasistreaming providing according to the embodiment of the present invention is different from a general streaming providing. In the quasistreaming providing, the music data (MIDI data) to be provided is downloaded completely and temporarily stored in a temporal storage area (buffer) in the client terminal 3. Then, when converting the temporally stored music data in the musical performance data event format into the audio data format is completed, the stored music data is deleted from the buffer.

Since, generally, music data in the musical performance data event format is smaller in its data size than that of music data in the audio data format, redistribution is easy. Also, since music data in the musical performance data event format is easy to be edited, it tends to have a copyright problem. Therefore, by executing the quasistreaming providing, only music data converted into the music data with the audio data format is left in the client terminal 3, and the original music data in the performance data event format is deleted.

At Step SS6, it is judged whether a download providing request in the audio data format is received from the client terminal 3 or not. In a case that the download providing request in audio data format is received, the process proceeds to Step SS7. In a case that the download providing request with audio data format is not received, the process proceeds to Step SS10 to terminate the process on the providing server 2 side.

At Step SS7, the selected music data is read from the MIDI music database MDB (FIG. 1), the music data is edited in accordance with the setting parameters SP1 set (selected) at Step SC6 described later.

At Step SS8, the edited music data in the musical performance data event format is converted to music data in the audio data format in accordance with the setting parameters SP2, for example, by starting the MIDI musical tone generator such as the MIDI-to-Audio converting unit 5 shown in FIG. 1. At Step SS9, the converted music data in the audio data format is downloaded and provided to the client terminal 3. Then, the process proceeds to Step SS10 to terminate the process on the providing server 2 side.

At Step SC1, a process on the client terminal 3 side is started, and the song selection screen data is requested by accessing to the providing server 2 at Step SC2. At Step SC3, the song selection screen data is received from the providing server 2, and for example, a selection screen is displayed on the display 14 (FIG. 2) based on the selection screen data. The selection screen includes at least a list of currently downloadable music data available in the MIDI music database MDB in the providing server 2. The user selects a song (music data) to be downloaded referring to the displayed selection screen.

At Step SC4, the download setting screen data corresponding to the selected song (music data) is requested to the providing server 2. When the download setting screen data is received, the download setting screen is displayed on the display 14 at Step SC5.

At Step SC6, the setting parameters SP1 and SP2 described in the above are selected (set) with reference to the download setting screen. Moreover, in a case that the user manually operates the selection whether the conversion of the selected music data from the musical performance data event format to the audio data format is executed in the client terminal 3 or not, it is selected at this step. Also, it is judged whether there is a MIDI musical tone generator such as the MIDI-to-Audio converter 5 on the client terminal 3 or not. In a case that the MIDI musical tone generator is not equipped with the client terminal 3, it can be automatically selected that the conversion is executed in the providing server 2. In a case that the client terminal 3 equips with the MIDI musical tone generator, it is preferable to be selected manually because the user may request the conversion in the providing server 2 for some reasons such as a case that the performance of the MIDI musical tone generator equipped with the client terminal 3 is inferior.

At Step SC7, it is judged whether there is a downloading instruction or not. In a case that the downloading instruction is detected, for example, in a case that the downloading button 121 in FIG. 3 is operated, the process proceeds to Step SC8 as indicated by an arrow marked "YES". In a case the downloading instruction is not detected, for example, the cancel button 122 is operated, the process proceeds to Step SC13 as indicated by an arrow marked "NO" to terminate the process on the client terminal 3 side.

At Step SC8, it is judged whether the conversion from the musical performance data event format to the audio data format (MIDI-to-Audio conversion) is executed in the client terminal 3 or not by referring setting at Step SC6. In a case that the conversion is executed in the client terminal 3, the process proceeds to Step SC9 as indicated by an arrow marked "YES". In a case that the conversion is executed in the providing server 2, the process proceeds to Step SC11 as indicated by an arrow marked "NO".

At Step SC9, the providing request (and setting parameter SP2) for requesting the quasistreaming providing of the selected music data in the music performance data event format (for example, MIDI format) is transmitted to the providing server 2. Then, the process proceeds to Step SC10, and a quasistreaming reception process in FIG. 5 described later is executed, and the process on the client terminal 3 side is terminated at Step SC13.

Moreover, in a case that the quasistreaming providing is executed, it is not necessary to transmit the setting parameters SP1 to the providing server 2. Also, the setting parameters SP2 may be transmitted, and editing of the music data in the musical performance data event format may be executed. In that case, a part or all of the setting parameters may be transmitted.

At Step SC11, the providing request and the setting parameters SP1 and SP2 for requesting the download providing of the selected music data in the audio data format is transmitted to the providing server 2.

At Step SC12, the music data transmitted from the providing server 2 is received, for example, the received music data is stored in the external storage device 15 (FIG. 2). Then, the process is terminated on the client terminal 3 side at Step SC13.

Figure 5:
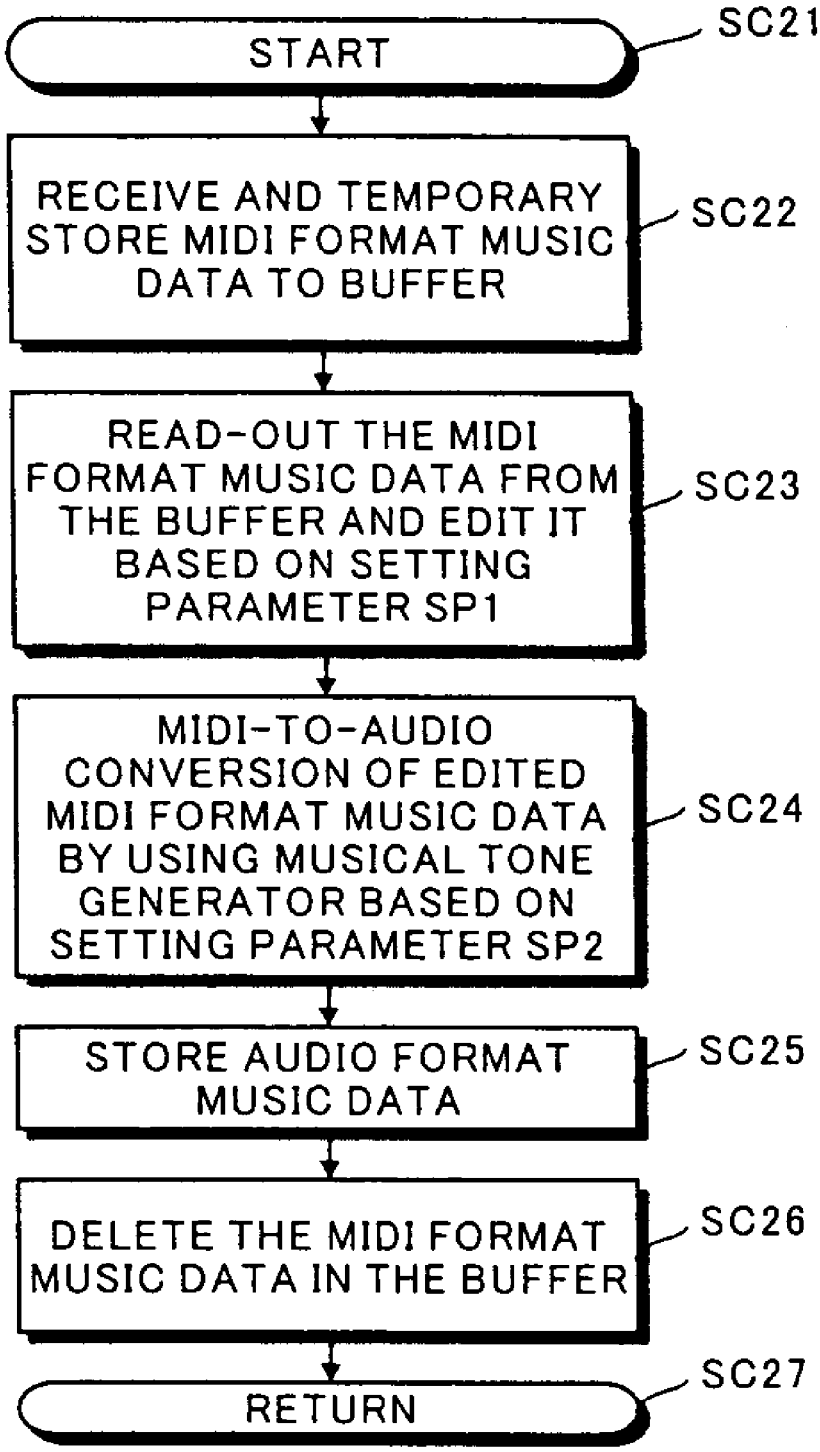
FIG. 5 is a flow chart representing a quasistreaming reception process executed at Step SC10 in FIG. 4.

FIG. 5 is a flow chart showing the quasistreaming reception process executed at Step SC10 in FIG. 4.

At Step SC21, the quasistreaming reception process is started. The music data in the musical performance data event format (for example, MIDI format) transmitted from the providing server 2 is received, for example, music data is stored in a temporal storage area (hereinafter called buffer) for buffering in the RAM 7 in FIG. 2 or the external storage device 15.

At Step SC23, the received music data in the musical performance data event format is automatically read from the buffer and edited in accordance with the setting parameters SP2 selected at Step SC6 in FIG. 4.

At Step SC24, the edited music data in the musical performance data event format (for example, MIDI format) is automatically converted to the music data in the audio data format in accordance with the setting parameters SP1 set at Step SC6 in FIG. 4 by, for example, automatically starting up the MIDI musical tone generator such as the MIDI-to-Audio converter 5 shown in FIG. 1.

At Step SC25, the converted music data in the audio data format is stored, for example, in the external storage device 15 and the like, and the music data in the musical performance data event format temporally stored in the buffer received from the providing server 2 is automatically deleted. Then, the process proceeds to Step SC27 to terminate the quasistreaming reception process, and the process returns to Step SC13 in FIG. 4.

As described in the above, according to the embodiment of the present invention, a multiplicity of music data in the musical performance data event format such as MIDI format and the like can be stored in the providing server 2, and the music data can be provided to the client terminal 3 with converting the music data from the music data in the musical performance data event format to that in the audio data format corresponding to the providing request for the music data from the client terminal 3 and the setting parameters SP. Therefore, it is not necessary for the music data in various audio data formats to be prepared in the providing server 2, while the music data in the various audio data formats can be provided.

Also, by doing that, music data in the musical performance data event format can be provided to a terminal that cannot reproduce music data. Moreover, in a case that a client terminal 3 is equipped with a musical tone generator that can reproduce music data in a musical performance data event format that is not available in the providing server 2, the music data can be reproduced in the client terminal 3.

Also, the providing server 2 according to the embodiment of the present invention can execute the quasistreaming providing and can make a client terminal 3 convert the music data in the musical performance data event format to the music data in the audio data format. Therefore, in a case that the client terminal 3 equips with a musical tone generating device that can reproduce music data in the musical performance data event format such as the MIDI musical tone generator. Therefore, music data in the musical performance data event format with smaller in file size can be provided.

Also, according to the embodiment of the present invention, the client terminal 3 can access to a server that stores a multiplicity of music data in the musical performance data event format such as the MIDI format and transmit a providing request for the music data and the setting parameters SP. Then, the requested music data in the musical performance data event format can be converted into the music data in the audio data format on the providing server, and the client terminal 3 can receive the requested desired music data. Therefore, it is not necessary that music data in various audio data formats are prepared in the providing server, while music data in various audio data formats can be provided.

Also, according to the embodiment of the present invention, the client terminal 3 receives music data in the musical performance data event format from the providing server 2 by the quasistreaming providing, and can convert the received music data in the musical performance data event format into the music data in the audio data format. By doing that, reception of the music data in the musical performance data event format that is relatively smaller in file size becomes possible, and shortening of download time can be achieved. Also, since data in the musical performance data event format provided by the quasistreaming providing is automatically deleted from the buffer after the format conversion, an illegal copy, an illegal redistribution and an illegal editing can be prevented. Also, since the user does not need to manually store music data in the musical performance data event format temporarily and instruct execution of the MIDI-to-Audio conversion, the user's operation will be little.

Also, according to the embodiment of the present invention, even if the client terminal 3 equips with a musical tone generator that can reproduce music data in a musical performance data event format such as the MIDI musical tone generator, the format conversion in the providing server is possible by a selection of a user. Therefore, the client terminal 3 that equips only with the musical tone generating device with low quality and low-performance can reproduce music data with high quality.

Moreover, well known copy guard technique is applied to music data with audio data format in the embodiment of the present invention, and it is preferable that an illegal copy, an illegal redistribution and an illegal editing of music data in audio data format is prevented.

The present invention has been described in connection with the preferred embodiments. The invention is not limited only to the above embodiments. It is apparent that various modifications, improvements, combinations, and the like can be made by those skilled in the art.

The entire content of Priority Document 2002-202505 is incorporated herein by reference.

What is claimed is:

1. A music data providing apparatus, comprising:

a storage device that stores a plurality of music data in a musical performance data event format;

a download selling screen transmitting device that transmits data relating to a download setting screen for a desired music selected by a user of a client terminal to the client terminal via a network, wherein the download setting screen includes an operator for designating whether conversion of the music data in a musical performance data format into music data in an audio data format is executed on the music data providing apparatus or on the client terminal;

a providing request receiving device that receives a request for providing music data corresponding to the desired music in an audio data format and a setting parameter from the client terminal via the network when the user of the client terminal has designated that the conversion of the music data in a musical performance data format into music data in an audio data format is executed on the music data providing apparatus by using the operator displayed on the download setting screen;

a converter that, in accordance with the received request and setting parameter, reads the music data corresponding to the desired music in a musical performance data event format from the storage device and converts the read music data into music data in an audio data format; and a music data transmitting device that transmits the converted music data in an audio data format to the client terminal.

2. A music data providing apparatus according to claim 1, wherein the setting parameter is at least one of a parameter for selecting stereophonic or monophonic, a parameter for selecting a sound quality, a parameter for selecting a data format, a parameter for selecting a tempo, a parameter for setting a key, a parameter relating to an effect process, a parameter relating to a tone color, a parameter relating to loudness of a tone, a parameter for selecting a musical performance part and a parameter for selecting a musical performance section.

3. A music data receiving apparatus, comprising:

a download setting screen receiving device that receives data relating to a download setting screen for a desired music from a server via a network, wherein the download setting screen includes an operator for designating whether conversion of the music data in a musical performance data format into music data in an audio data format is executed on the server or on the music data receiving apparatus;

a displaying device that displays the download setting screen for the desired music in accordance with the received data;

a designating device that designates that the conversion of the music data in a musical performance data format into music data in an audio data format is executed on the server by using the operator displayed on the download setting screen;

a providing request transmitting device that transmits a request for providing music data corresponding to the desired music in an audio data format and a setting parameter to the server, so as to request the server for conversion of the music data in a musical performance event data format into music data in an audio data format and transmission of the converted music data to the music data receiving apparatus; and a music data receiving device that receives the music data corresponding to the desired music in an audio data format converted in accordance with the transmitted request and setting parameter via the network.

4. A music data providing apparatus according to claim 3, wherein the setting parameter is at least one of a parameter for selecting stereophonic or monophonic, a parameter for selecting a sound quality, a parameter for selecting a data format, a parameter for selecting a tempo, a parameter for setting a key, a parameter relating to an effect process, a parameter relating to a tone color, a parameter relating to loudness of a tone, a parameter for selecting a musical performance part and a parameter for selecting a musical performance section.

5. A music data receiving apparatus, comprising:

a providing request transmitting device that transmits a request for providing music data to a server storing a plurality of music data in a musical performance data event format via a network, each music data in a musical performance data event format including a series of event data;

a music data receiving device that receives music data in a musical performance data event format provided in accordance with the transmitted request via the network;

a temporal storage device that temporally stores the received music data in a musical performance data event format;

an input device that inputs a setting parameter for the received music data in a musical performance data event format;

a converter that converts the music data in a musical performance event data format stored in the temporal storage device into music data in an audio data format in accordance with the input setting parameter; and a storage device that stores the converted music data in an audio data format; and a deleting device that deletes the music data in a musical performance data event format stored in the temporal storage device automatically after the conversion of the converter.

6. A music data providing apparatus according to claim 5, wherein the selling parameter is at least one of a parameter for selecting stereophonic or monophonic, a parameter for selecting a sound quality, a parameter for selecting a data format, a parameter for selecting a tempo, a parameter for setting a key, a parameter relating to an effect process, a parameter relating to a tone color, a parameter relating to loudness of a tone, a parameter for selecting a musical performance part and a parameter for selecting a musical performance section.

7. A program stored in a computer-readable medium, which a computer storing music data in a musical performance data event format executes to realize a music data providing process, comprising the instructions for:

(a) transmitting data relating to a download setting screen for a desired music selected by a user of a client terminal to the client terminal via a network, wherein the download setting screen includes an operator for designating whether conversion of the music data in a musical performance data format into music data in an audio data format is executed on the music data providing apparatus or on the client terminal;

(b) receiving a request for providing music data corresponding to the desired music in an audio data format and a selling parameter from the client terminal via the network when the user of the client terminal has designated that the conversion of the music data in a musical performance data format into music data in an audio data format is executed on the music data providing apparatus by using the operator displayed on the download setting screen;

(c) reading, the music data corresponding to the desired music in a musical performance data event format in accordance with the received request;

(d) converting the read music data into music data in an audio data format in accordance with the received setting parameter; and (e) transmitting the converted music data in an audio data format to the client terminal.

8. A program stored in a computer-readable medium, which a computer executes to realize a music data receiving process, comprising the instructions for:

(a) receiving data relating to a download setting screen for a desired music from a server via a network, wherein the download setting screen includes an operator for designating whether conversion of the music data in a musical performance data format into music data in an audio data format is executed on the server or on the music data receiving apparatus;

(b) displaying the download setting screen for the desired music in accordance with the received data;

(c) designating that the conversion of the music data in a musical performance data format into music data in an audio data format is executed on the server by using the operator displayed on the download setting screen;

(d) transmitting a request for providing music data corresponding to the desired music in an audio data format and a setting parameter to the server so as to request the server for conversion of the music data in a musical performance event data format into music data in an audio data format and transmission of the converted music data to the music data receiving apparatus; and (e) receiving music data corresponding to the desired music in an audio data format converted in accordance with the transmitted request and setting parameter via the network.

9. A program stored in a computer-readable medium, which a computer executes to realize a music data receiving process, comprising the instructions for:

(a) transmitting a request for providing music data to a server storing a plurality of music data in a musical performance data event format via a network, each music data in a musical performance data event format including a series of event data;

(b) receiving music data in a musical performance data event format provided in accordance with the transmitted request via the network, each music data in a musical performance data event format including a series of event data;

(c) temporally storing the received music data in a musical performance data event format;

(d) inputting a setting parameter for the received music data in a musical performance data event format;

(e) converting the temporally stored music data in a musical performance event data format into music data in an audio data format in accordance with the input setting parameter and storing said converted music data in an audio data format; and (f) deleting the temporally stored music data in a musical performance data event format automatically after the conversion at the converting step (e).

10. A music data providing apparatus, comprising:

a storage device that stores a plurality of music data in a musical performance event data format, each music data in a musical performance data event format including a series of event data;

a music selection screen transmitting device that transmits data for a screen for selecting music to a client terminal via a network, so as to the screen for selecting music is displayed on the client terminal side;

a music selection receiving device that receives a result of selection of desired music by a user of the client terminal from the client terminal via the network;

a music download setting screen transmitting device that transmits data for a download setting screen corresponding to the desired music selected by the user of the client terminal in accordance with the result of the selection to the client terminal in accordance with the result of the selection to the client terminal via the network;

a providing request receiving device that receives a request for providing music data corresponding to the desired music in an audio data format and a setting parameter via the network;

a converter that reads music data corresponding to the desired music in a musical performance event data format from the storage device and converts the read music data into music data in an audio data format in accordance with the received request and setting parameter; and a music data transmitting device that transmits the music data converted into an audio data format to the client terminal via the network.

11. The music data providing apparatus according to claim 10, wherein the download setting screen includes an operator for designating whether conversion of the music data in a musical performance data format into music data in an audio data format is executed on the music data providing apparatus or on the client terminal.

12. A music data receiving apparatus, comprising:

a music selection screen receiving device that receives data for a screen for selecting music from a server storing a plurality of music data in a musical performance event data format via a network, each music data in a musical performance data event format including a series of event data;

a displaying device that displays the music selection screen in accordance with the data received from the server;

a selecting device that selects desired music by using the music selection screen;

a providing request transmitting device that transmits a request for providing music data corresponding to the desired music and a setting parameter to the server via the network, so as to request the server for conversion of the music data in a musical performance event data format into music data in an audio data format and transmission of the converted music data to the music data receiving apparatus; and a music data receiving device that receives the music data corresponding to the desired music in an audio data format in accordance with the transmitted request and setting parameter.

* * * * *

UNITED STATES PATENT AND TRADEMARK OFFICE

CERTIFICATE OF CORRECTION

PATENT NO. : 7,268,287 B2
APPLICATION NO. : 10/616202
DATED : September 11, 2007
INVENTOR(S) : Susumu Kawashima It is certified that error appears in the above-identified patent and that said Letters Patent is hereby corrected as shown below:

Col. 12, Line 10, Claim 1:
"selling" should be --setting--

Col. 13, Line 49, Claim 6:
"selling" should be --setting--

Col. 14, Line 5, Claim 7:
"selling" should be --setting--

Signed and Sealed this

Twenty-fifth Day of December, 2007

JON W. DUDAS
*Director of the United States Patent and Trademark Office*